US009689200B2

(12) United States Patent
Greening

(10) Patent No.: US 9,689,200 B2
(45) Date of Patent: Jun. 27, 2017

(54) ROLLER BLIND

(71) Applicant: Louver-Lite Limited, Hyde (GB)

(72) Inventor: Andrew Greening, Sandbach (GB)

(73) Assignee: Louver-Lite Limited, Cheshire (GB)

( * ) Notice: Subject to any disclaimer, the term of this patent is extended or adjusted under 35 U.S.C. 154(b) by 0 days.

(21) Appl. No.: 14/905,238

(22) PCT Filed: Jul. 14, 2014

(86) PCT No.: PCT/GB2014/052146
§ 371 (c)(1),
(2) Date: Jan. 14, 2016

(87) PCT Pub. No.: WO2015/008050
PCT Pub. Date: Jan. 22, 2015

(65) Prior Publication Data

US 2016/0153230 A1 Jun. 2, 2016

(30) Foreign Application Priority Data

Jul. 15, 2013 (GB) ..... 1312611.5

(51) Int. Cl.
*E06B 9/66* (2006.01)
*E06B 9/40* (2006.01)
(Continued)

(52) U.S. Cl.
CPC ..... *E06B 9/40* (2013.01); *E06B 9/24* (2013.01); *E06B 9/42* (2013.01); *E06B 9/64* (2013.01);
(Continued)

(58) Field of Classification Search
CPC ... E06B 9/40; E06B 9/34; E06B 9/262; E06B 9/64; E06B 9/66
(Continued)

(56) References Cited

U.S. PATENT DOCUMENTS 2,569,599 A * 10/1951 Cole ..... E04F 10/0633 160/133
3,362,461 A * 1/1968 Stark ..... E06B 9/44 160/323.1
(Continued)

FOREIGN PATENT DOCUMENTS

| | | |
|---|---|---|
| DE | 10021959 | 6/2001 |
| DE | 20103997 | 2/2002 |
| GB | 2445289 | 7/2008 |

OTHER PUBLICATIONS

Search Report and Written Opinion for International Application Serial No. PCT/2014/052146 dated Nov. 7, 2014.

*Primary Examiner* — David Purol
(74) *Attorney, Agent, or Firm* — Haugen Law Firm PLLP

(57) ABSTRACT

A roller blind including a sheet element secured at one end to a roller tube mounted for rotation, and secured at its opposite end to a fixed element located adjacent to the roller tube such that the sheet element defines a return portion located between the two ends; and a roller blind bottom bar located within the return portion, wherein the roller blind bottom bar includes a tubular body and an end cap carried by each end of the tubular body, the end caps including a proximal portion located adjacent to the tubular body, a distal portion spaced from the tubular body, and an outwardly flared portion located between the proximal and distal portions such that the end cap flares outwards from the proximal portion to the distal portion.

9 Claims, 4 Drawing Sheets

(51) Int. Cl.

| | |
|---|---|
| ***E06B 9/42*** | (2006.01) |
| ***E06B 9/64*** | (2006.01) |
| ***E06B 9/68*** | (2006.01) |
| *E06B 9/24* | (2006.01) |

(52) U.S. Cl.
CPC *E06B 9/68* (2013.01); *E06B 9/66* (2013.01); *E06B 2009/2405* (2013.01); *E06B 2009/2447* (2013.01)

(58) Field of Classification Search
USPC ..... 160/121.1, 262, 133, 323.1
See application file for complete search history.

(56) References Cited

U.S. PATENT DOCUMENTS

| | | | | |
|---|---|---|---|---|
| 3,789,904 | A * | 2/1974 | Takazawa | A47H 23/06 160/120 |
| 3,980,122 | A * | 9/1976 | Takazawa | E06B 9/64 160/120 |
| 6,189,592 | B1 * | 2/2001 | Domel | E06B 9/24 160/241 |
| 7,174,940 | B2 * | 2/2007 | Nien | E06B 9/42 160/120 |
| 7,267,156 | B2 | 9/2007 | Byeon | |
| 7,806,160 | B2 * | 10/2010 | Byeon | E06B 9/40 160/11 |
| 2012/0000617 | A1 * | 1/2012 | Chu | E06B 9/24 160/349.1 |

* cited by examiner 28
34
30
22b
36
16
32
20

2
12
14
6
4
18
24
10
8
26
22a

ROLLER BLIND

The present invention relates to roller blind bottom bars and to roller blinds incorporating such bottom bars.

Conventional roller blinds include a sheet element, typically formed from a fabric material, which is secured at one end (i.e. a top end) to a roller mounted for rotation and which includes at its opposite (bottom) end a weighted bottom bar. The weighted bottom bar maintains the sheet element in a substantially planar configuration when deployed (extended) from the roller.

More recently a new type of roller blind has been introduced. In this new type of roller blind, the roller tube is mounted for rotation adjacent to a fixed element, such as a housing within which the roller tube is housed. The roller blind sheet element is secured at one end to the roller, but the opposite end is secured to the fixed element, thus forming a return portion (sometimes referred to as a bight) between the opposed ends. A bottom bar is located within the return portion such that the sheet element loops around the bottom bar, thus defining a front portion of the sheet (i.e. the portion which faces towards the room) and a rear portion of the sheet (i.e. the portion which faces towards the window or other architectural opening to be covered by the blind in use). Examples of this new type of roller blind can be seen in U.S. Pat. No. 6,189,592, GB2437734 and U.S. Pat. No. 7,174,940.

The bottom bars of the new type of roller blinds either remain stationary with respect to the blind sheet, in which case the blind sheet slides around the bottom bar when it is retracted or deployed; or the bottom bar rotates within the return portion as the sheet is retracted or deployed. Where the bottom bar remains rotationally fixed relative to the sheet, there is clearly friction between the sheet and bottom bar. Furthermore, where the bottom bar rotates within the return portion as the sheet is deployed or retracted, the edge of the sheet may contact and rub against the end portions of the bottom bar, which in turn can lead to fraying of the side edge portions of the roller blind sheet.

In order to prevent or to mitigate against undesired fraying of the sheet material through frictional contact with the bottom bar, the present invention is provided.

According to a first aspect of the invention, there is provided a roller blind including a sheet element secured at one end to a roller tube mounted for rotation, and secured at its opposite end to a fixed element located adjacent to the roller tube such that the sheet element defines a return portion located between the two ends; and a roller blind bottom bar located within the return portion, wherein the roller blind bottom bar includes a tubular body and an end cap carried by each end of the tubular body, the end caps including a proximal portion located adjacent to the tubular body, a distal portion spaced from the tubular body, and an outwardly flared portion located between the proximal and distal portions such that the end cap flares outwards from the proximal portion to the distal portion.

In this aspect of the invention, the sheet element loops around the bottom bar to define a front portion of the sheet element and a rear portion of the sheet element.

The outwardly flared portion of the end caps helps to maintain the roller blind bottom bar in a centred position relative to the return portion of the sheet by gently urging the ends of the bottom bar away from the edges of the sheet should the bottom bar become non-centred. This prevents or minimises frictional contact between the edge of the sheet and any vertical end portions of the bottom bar, and accordingly prevents or minimises the risk of fraying to the side edge portions of the sheet.

In the context of the present invention, the term "flared" means that the diameter of the flared portion of the end caps increases as a gradient from the proximal end to the distal end. Thus, the term outwardly flared may be construed as radially outwardly flared. The increase in the diameter may be a constant increase such that the diameter varies proportionally with distance from the proximal end of the end cap. Alternatively, the flared portion may be trumpet- or bell-shaped. Thus, the flared portion, when viewed in cross-section, may be seen as an inclined straight line or a curved line. A combination of "straight" flared and "curved" flared portions is also within the scope of the invention. In other words, the gradient may be a fixed gradient or it may be a variable gradient.

The end caps of the bottom bar may be formed as one-piece construction with the tubular or cylindrical body. Thus, the end caps may be integral with the tubular or cylindrical body. Alternatively, the tubular or cylindrical body and the end caps may be separate components which are adapted or configured to be coupled together.

In an embodiment of the invention, the bottom bar comprises a tubular body and a pair of end caps formed as separate components. Suitably, the end caps are secured in use to the tubular body via a friction fit.

Suitably, the bottom bar body is tubular or it is cylindrical and includes axial apertures at both ends, wherein each end cap includes a projection which forms a friction fit within the respective aperture. In order to assist with the formation of the friction fit, the projection of each end cap may include one or more radially outwardly extending ribs. The ribs may be deformable, such as, for example, ribs known as "crush ribs". Such ribs are deformed upon insertion of the projection into its respective aperture as the ribs are arranged to define an outer diameter which is slightly greater than the corresponding inner diameter of the aperture. The act of crushing or deforming the ribs upon insertion of the projection into the corresponding aperture generates a greater frictional force between the bottom bar body and the respective end caps.

The bottom bar may form part of a bottom bar assembly. The bottom bar assembly suitably includes a bottom bar as defined anywhere hereinabove and a pair of opposed mountings, wherein the bottom bar is rotatably coupled to the mountings. Thus, each end cap may be rotatably coupled to a respective mounting.

Each end cap may include an aperture defined within its distal end portion and each of the mountings may include a stub axle, trunnion or other axial projection configured to be borne within the end cap aperture. Of course, the skilled person will appreciate that the aperture/axle arrangement may be reversed such that the mountings may include the apertures and the end caps may include the stub axle/axial projection.

The opposed mountings may form part of a bottom bar housing which is configured to house the bottom bar in use. Thus, the bottom bar housing may include a housing body and a pair of opposed mountings in the form of end plates. It will be appreciated that in such embodiments, the housing body will necessarily include an axial slot or opening to allow the sheet element to loop around the bottom bar located within the housing.

The roller blind includes a sheet element. For roller blinds, the sheet element functions to control light and optionally heat transmission into a room. The sheet element may be formed from a woven fabric substrate, a non-woven fabric substrate, a continuous polymeric substrate or a laminated substrate comprising two or more individual sheet elements. The sheet element may include a plurality of panels where different panels may have different light and/or heat transmission properties. In this way, the alignment of the panels on the front and rear portions of the sheet element will determine the overall light/heat transmission properties of the blind and this can be varied by aligning different pairs of panels (i.e. aligning different front and rear panels).

The roller blind may include an electric motor which may in turn be located within the roller tube. The electric motor in such embodiments is suitably arranged to drive the roller tube to rotate. Thus, the electric motor may be used to retract and deploy the sheet element of the blind. The electric motor may be powered by a mains electrical supply or via a battery supply. Where the electrical supply is via one or more batteries, these may be rechargeable or replaceable. In embodiments of the invention which include an electric motor, the motor may be controlled by a switch unit, which may be remote from the blind assembly or electrically connected to it.

In an embodiment of the invention, the roller tube is mounted for rotation within a housing. In such an embodiment, the opposite end of the sheet element may be secured to or within the housing. Thus, a body of the housing may form the fixed element.

In an embodiment of the invention, the roller blind further includes a drive bush connected to the roller tube in order to drive the roller tube to rotate. In an embodiment of the invention, the drive bush is driven by the electric motor referred to above. In an alternative embodiment, the drive bush is connected to a drive chain, operable by a user, via a sprocket wheel. Thus, the drive chain is suitably coupled to the sprocket wheel, which in turn may be connected to the drive bush. In order to prevent the weight of the sheet element causing the roller tube to rotate unintentionally, a clutch may be provided between the sprocket wheel and the drive bush, such that the clutch may permit the rotation of the roller tube by the drive chain acting on the sprocket wheel and in turn on the drive bush, while the clutch may also prevent the undesired rotation of the roller tube by the weight of the sheet element acting on it. This type of arrangement will be familiar to those skilled in the art of roller blinds, as it defines an arrangement which permits the roller blind to be raised or lowered manually by a drive chain. Accordingly, the roller blind may be effectively operated by a conventional chain-driven roller blind assembly. Such an arrangement is described in U.S. Pat. No. 7,100,668, the contents of which are incorporated herein in their entirety. Collectively, the drive bush, the sprocket wheel, the drive chain and/or the clutch may be referred to as a control unit.

Additionally or alternatively, the roller tube may form part of a spring driven or spring assisted roller blind. Thus, the assembly may further include a spring assembly housed within the roller tube which is adapted to bias the roller blind sheet to a retracted configuration. Thus, the spring assembly is suitably configured to store energy upon deployment of the sheet element and to release energy upon retraction of the sheet element. The inclusion of a spring assembly within the roller tube assists with or causes the retraction or raising of the sheet element. This may be particularly useful where the sheet element is relatively heavy. In accordance with this invention, the sheet element is effectively doubled over, which results typically in a heavier sheet element compared with conventional "single" sheet elements. In such embodiments, the spring assembly effectively assists the user to raise or retract the sheet element.

Such roller tubes may also include a releasable lock mechanism to lock selectively the roller sheet in a desired configuration.

Blind components are typically sold by the manufacturers to blind installers, who then take the components to build and install the blinds for the end user. Thus, according to a second aspect of the invention, there is provided a kit of parts for assembling a roller blind as defined herein, the kit including a bottom bar comprising a tubular body and two end caps, the end caps each including a proximal portion located adjacent to the tubular body in use, a distal portion spaced from the tubular body, and an outwardly flared portion located between the proximal and distal portions such that the end cap flares outwards from the proximal portion to the distal portion; a roller tube; a fixed element; and a sheet element.

The bottom bar, sheet element and fixed element may be as defined anywhere hereinabove.

In the kit, the sheet element is adapted to be secured at one end to the roller tube and secured at its opposite end to the fixed element. The kit of parts may further include a control unit as defined anywhere herein and/or an idle end assembly.

The fixed element may be in the form of a housing which is adapted to rotatably receive therein the roller tube.

The kit may also include a pair of mounting brackets adapted to rotably mount therebetween the roller tube.

As noted above, the term "control unit" is an assembly of components which together cooperate to raise and lower (retract and deploy) the sheet element. The control unit may include an electrical motor or it may include a drive chain, a sprocket wheel, a drive bush and/or a clutch. The control end is typically coupled to the roller tube in use to control its rotation.

By the term "idle end assembly", it is meant an end of a roller blind which in use is rotatably coupled to a bracket and which is opposite to the control unit of the blind. The idle end typically includes an idle end bush adapted to engage one end of a roller tube and forms a bearing/axle arrangement with an idle end bracket which is adapted to allow the idle end of the roller tube to rotate relative to the idle end bracket. An example of a suitable idle end assembly is described and discussed in WO2010/139945.

The skilled person will appreciate that the features described and defined in connection with the aspect of the invention and the embodiments thereof may be combined in any combination, regardless of whether the specific combination is expressly mentioned herein. Thus, all such combinations are considered to be made available to the skilled person.

An embodiment of the invention will now be described, by way of example only, with reference to the accompanying drawings in which.

For the avoidance of doubt, the skilled person will appreciate that in this specification, the terms "up", "down", "front", "rear", "upper", "lower", "width", etc. refer to the orientation of the components as found in the example when installed for normal use as shown in the Figures.

Figure 1:
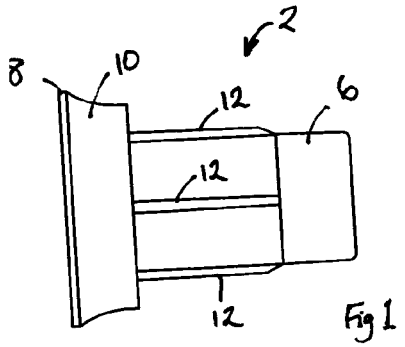
FIG. 1 is side elevational view of an end cap of a bottom bar forming part of the invention.

FIG. 1 shows an end cap 2 of a bottom bar 4. The end cap 2 includes a cylindrical proximal portion 6, a distal end portion 8 and an outwardly flared intermediate portion 10 located between the cylindrical proximal portion 6 and the distal end portion 8.

Four deformable, radially outwardly extending ribs 12 are provided on the cylindrical proximal portion 6.

Figure 2:
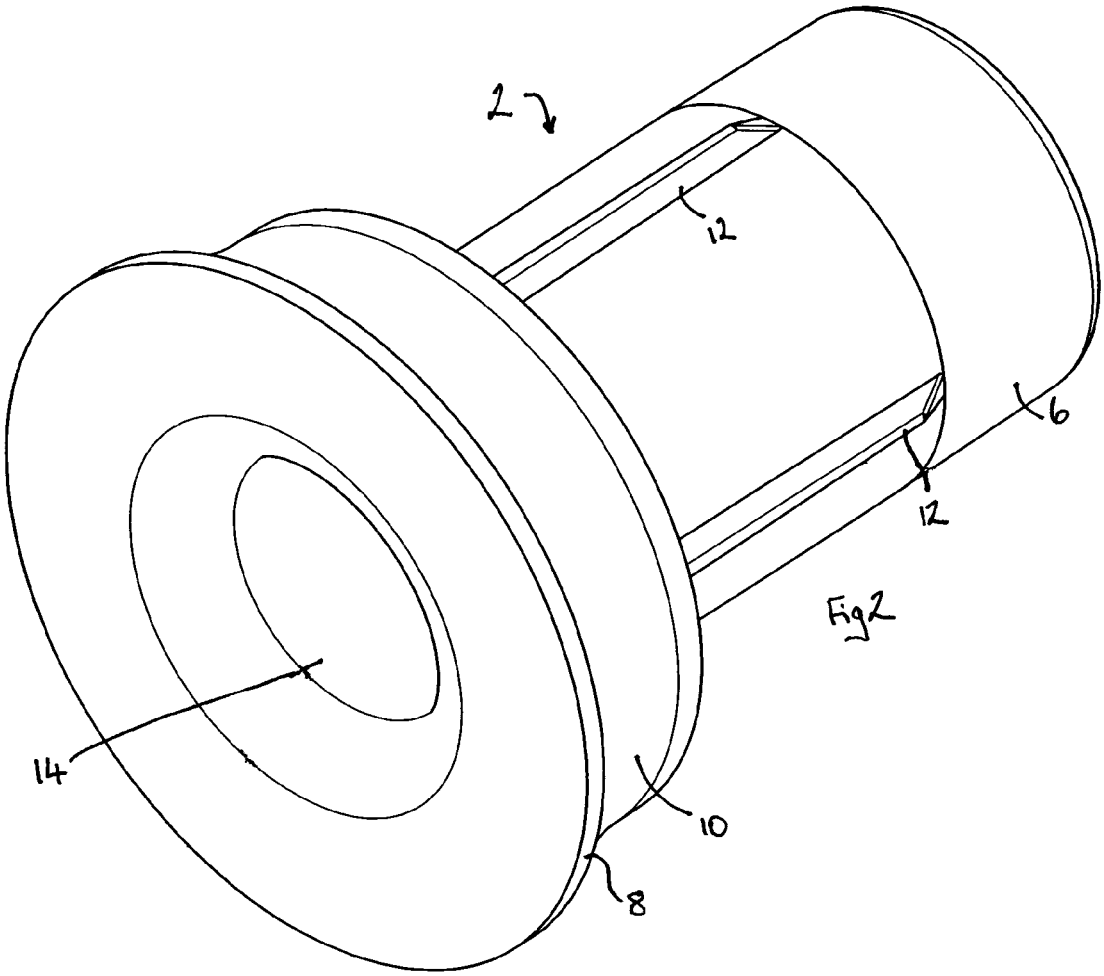
FIG. 2 is a perspective view of the end cap of FIG. 1.

As shown in FIG. 2, the end cap 2 further includes an axial aperture 14 which opens at the distal end portion.

Figure 3:
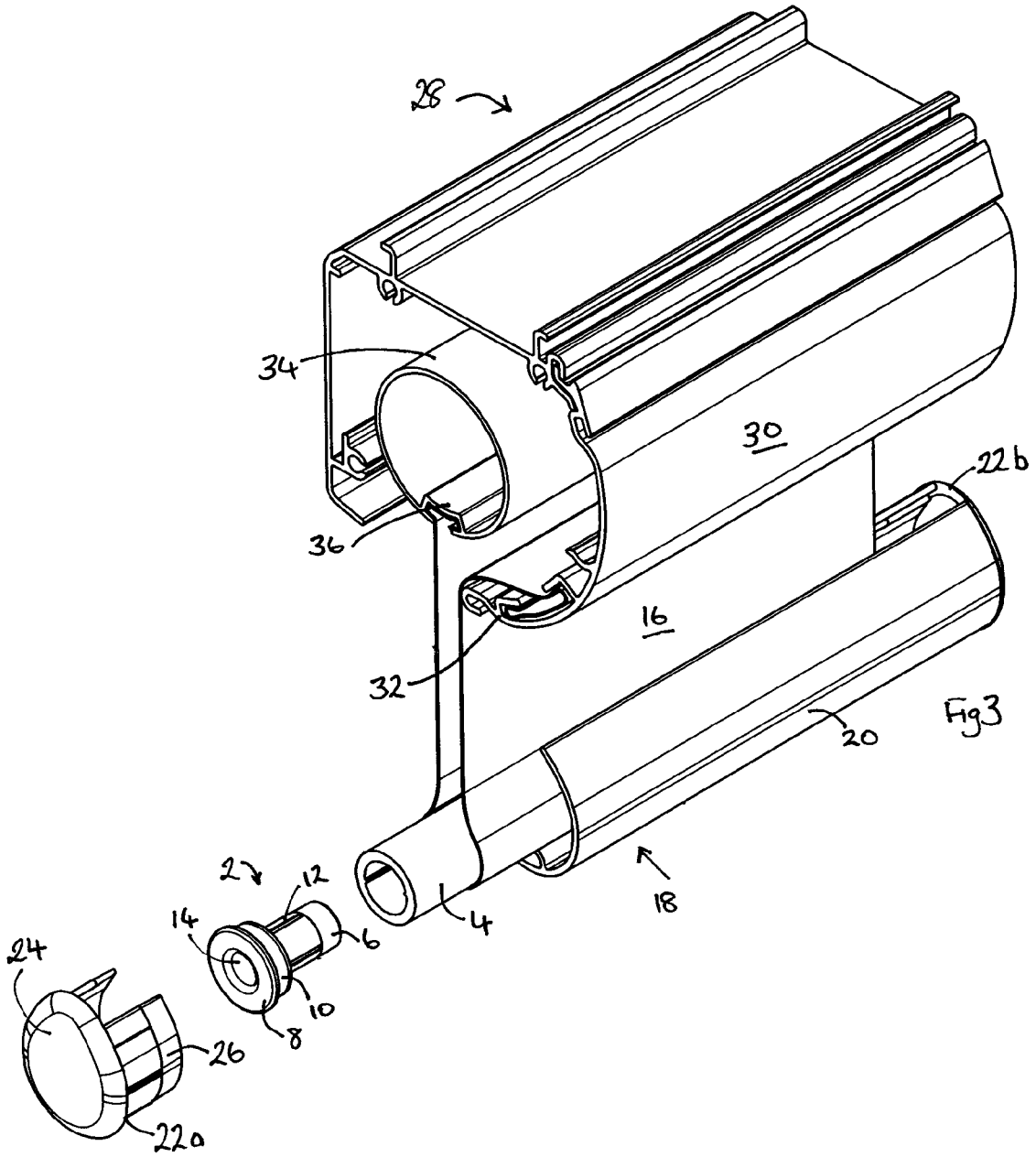
FIG. 3 is a cut-away perspective view of a roller blind according to the invention.

FIG. 3 shows a roller blind incorporating the bottom bar 4. The roller blind includes a sheet element 16 looped around the bottom bar 4. The bottom bar 4 is mounted for rotation with a bottom bar housing 18. The bottom bar housing 18 includes a housing body 20 and a pair of mounting elements 22*a*, 22*b*, which in use close the housing body 20 and support for rotation the end caps 2 of the bottom bar 4.

The housing body 20 is a hollow tube that defines an open, upwardly facing slot extending the entire length of the body 20. The two mounting elements 22*a*, 22*b* each include an end plate 24 and an engagement portion 26 which is sized and configured to form a friction fit within the housing body 20. Each engagement portion also defines an upward facing slot configured to align with the slot defined by the housing body 20.

The mounting elements 22*a*, 22*b* each include an axially projecting stub axle (not shown) which is configured to be borne within the aperture 14 defined within the respective end cap 2.

The roller blind further comprises an upper housing 28 including a housing body 30 which defines a sheet element securing portion 32 and a downwardly facing slot. Housed within the upper housing 28 is a roller tube 34. The roller tube is a conventional roller tube and includes a sheet element securing channel 36. The roller tube 34 is coupled to a conventional control unit and a conventional idle end assembly (not shown) such that the roller tube is rotatable within the upper housing 28 via the control unit. The control unit comprises an operating chain, a sprocket wheel, a clutch and a drive bush.

Figure 4A:
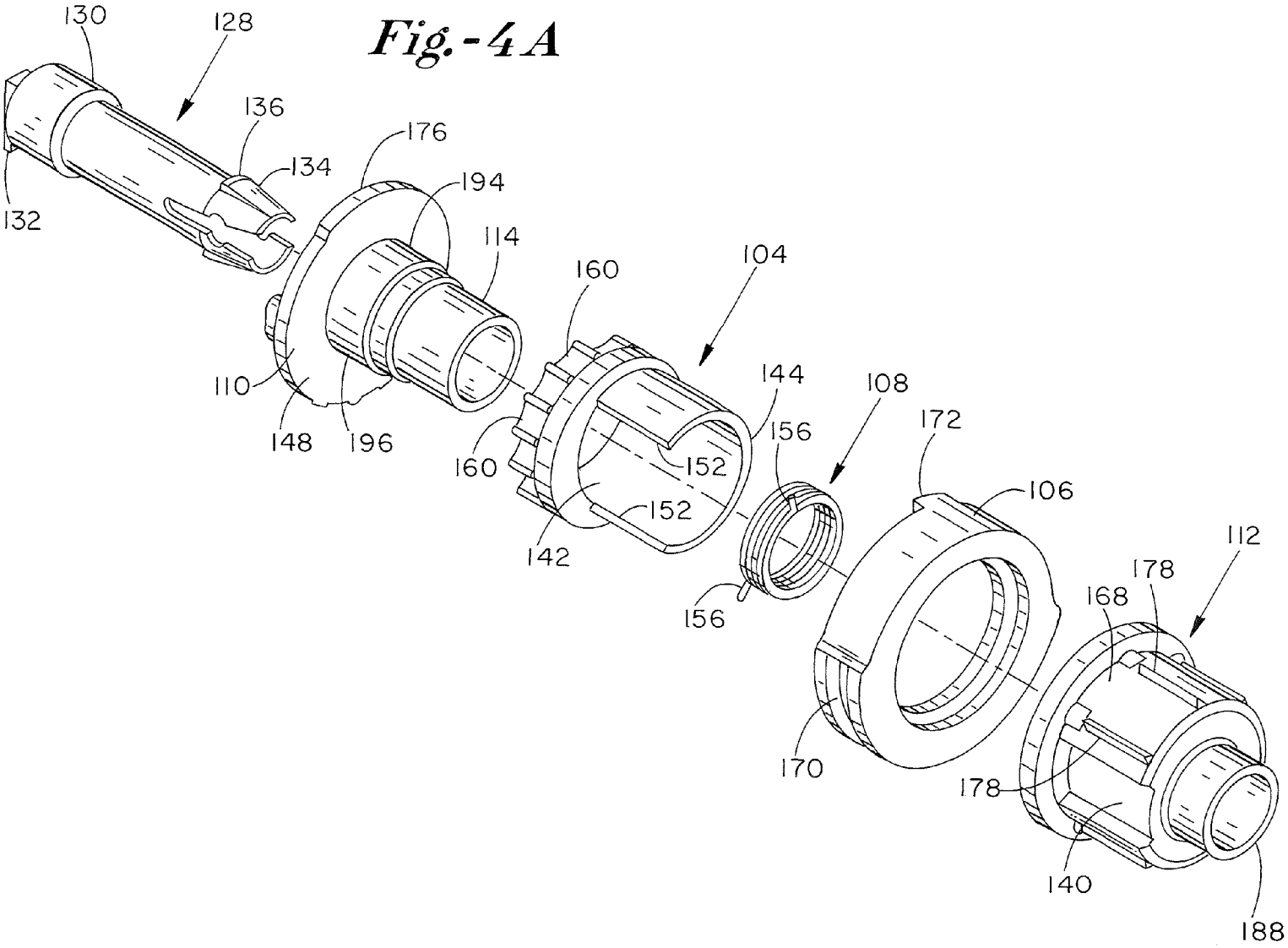
FIG. 4A is an exploded rear perspective view of a control unit of the present invention.
Figure 4B:
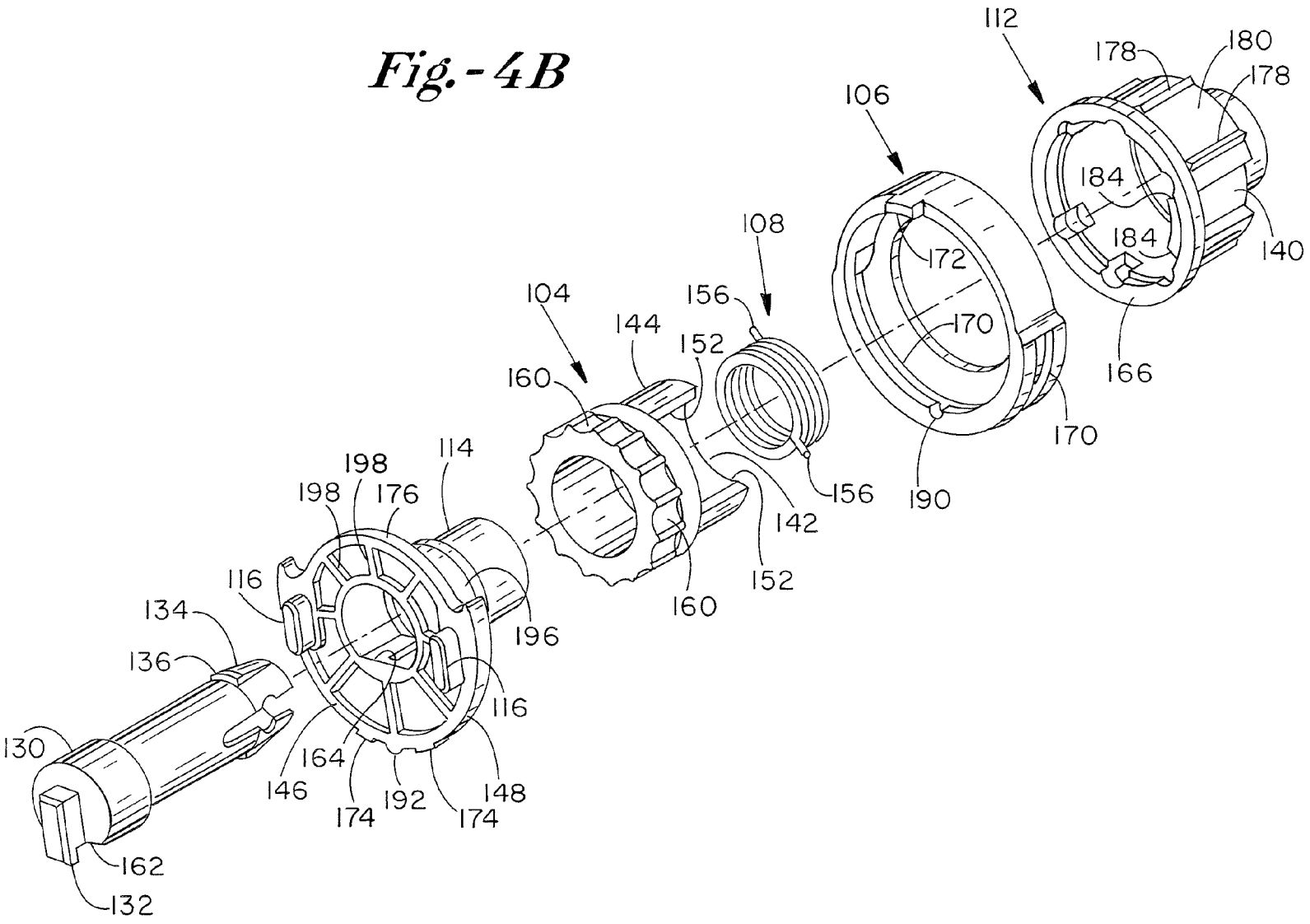
FIG. 4B is an exploded front perspective view of a control unit of the present invention.

FIGS. 4A and 4B provide exploded views of a control unit 102 that may be utilized in the roller blind of the present invention. At a first end, positioned in use towards the face of control unit 102 which incorporates the sprocket support 110, directly behind the external face 118 of sprocket support 110 is sprocket wheel 104 itself, comprising regularly spaced recesses 160 designed to accommodate the balls of a chain during use.

The chain for use with this control unit will typically comprise a chord of metal or plastic links with a series of balls spaced e.g. 7 mm or so, which may engage recesses 160 (but not necessarily each recess; the chain may for example engage every other recess). The chain is held in place by the inner annular surfaces of housing 106. It is this interaction between the chain and sprocket wheel 104 which when the chain is pulled causes rotation within the unit. The opposite end of the sprocket wheel component comprises a cut-away portion 142, the edges of the cut-away portion 152 engaging the wrap spring juts 156 and the moulded indent 140 of splined bush 112 in use, forcing these components to rotate.

Sprocket wheel 104 is covered by a chain guard housing 106 positioned substantially flush with external face 118 of sprocket support 110 and sized to surround and loosely engage external face 118 of sprocket support 110. Chain guard housing 106 also comprises an aperture 170 through which the chain hangs.

In this embodiment, the chain guard housing 106 comprises one lug 172, formed during the moulding of this component. Lug 172 is positioned to extend perpendicular to the face of control unit 102 which incorporates the sprocket support 110 and from the top center of this face when control unit 102 is in use. Preferably, the mounting bracket for mounting this control unit has a recess which cooperates with lug 172 during assembly, and ensures that the chain guard (which is otherwise capable of rotating about the sprocket wheel) is correctly orientated when assembled. Preferably, the correct orientation provides for the aperture 170 to be situated pointing symmetrically vertically downwards, which in turn facilitates the chain to hang vertically downwards.

Chain guard housing 106 also features a small groove 190 positioned at the bottom center of the housing on the face of control unit 102 which incorporates sprocket support 110. Groove 190 is adapted to receive and loosely engage with a small rounded projection 192 which extends radially from the outer edge of external face 118 of sprocket support 110. This allows chain guard housing 106 and sprocket support 110 to rotate independently when orbital pressure is applied to the unit, and yet allows the two components to remain releasably detained in a preferred configuration during use.

Mounting brackets 180 or 182, which maybe made of metal or plastics, may be used to mount the blind across the window or other aperture. Bracket 180, which may be made of injection moulded plastics materials, has been modified from those known in the art through the insertion of three additional recesses 184. The recesses 184 are necessary to accommodate lug 172 found on the face of control unit 102 which incorporates sprocket support 110. Bracket 182, which may be made of metal, is adapted to interact with this embodiment of the invention by extending three of the receiving cavities 186 out towards the edge of the bracket, thereby facilitating engagement with lug 172. Three channels are incorporated, although only one additional lug 172 is present in this embodiment so that the number of manufactured stock items may be kept to a minimum. The modified plastic and metal brackets 180 and 182 will engage control unit 102 in any of three different orientations.

Sprocket support 110 comprises sprocket support face 118 which is substantially annular and has extending towards the rear of control unit 102 from the inner edge of the ring, a roughly cylindrical portion 194. In this embodiment, sprocket support 110 is injection moulded from e.g. nylon. The cylindrical portion 166 of this component is of two diameters, the larger diameter portion 196 of the cylinder extending directly from sprocket support face 118 and of a size to rotatably engage sprocket wheel 104. The smaller diameter portion of the cylinder provides a sprocket spring friction surface 114 and extends beyond the larger diameter portion 196 towards the rear of control unit 102.

Wrap spring 108 rests on and engages sprocket spring friction surface 114 which interacts with, and provides a friction fitting surface for the spring. The friction generated between these two components prevents rotation of the blind until a certain minimum rotation force is applied to the control unit, by pulling the chain. As described herein, once the minimum force has been exceeded, the wrap spring effectively temporarily releases itself from sprocket spring friction surface 114, and permits rotation. In addition, it is the friction caused by the movement of these two components relative to one another, which controls the speed of rotation of the elements of control unit 102.

The external face 118 of sprocket support 110 includes regularly spaced radial strengthening spines 198. In addition, this face includes two engagement pins 116 which are rectangular with rounded corners, positioned mid-way up the face and substantially at either edge of external face 118 of sprocket support 110 with their long axes parallel to the long axis of locking-lug of the center-pin stop element 132. Engagement pins 116 project outwards from external face 118 of sprocket support 110 and interact with a mounting bracket when the blind is in use.

In the present embodiment, two small angular contact projections 174 and one angular contact surface 176 extend radially from the edge of external face 118 of sprocket support 110. The angular contact projections and surfaces 174 and 176 are in frictional contact with the inner surface of chain guard housing 106.

There is a central bore through each component of the control unit. This bore is designed to receive center pin 128. Centre pin 128 is of plastics construction and operates in the same way as prior art center pin 28 described above. Like the prior art center pin, it has a flattened surface 162 which cooperates with a corresponding flattened surface 164 on sprocket support 110 to prevent rotation between them.

On assembly a splined bush 112 snap fits over two center pin lugs 136. As with center pin 128, splined bush 112 is of one-piece plastics construction. Splined bush 112 comprises a cap front 166 which lies adjacent to the rear face of chain guard housing 116 in use. Extending through the control unit, away from chain guard housing 116, the cap front 166 is connected to a roughly cylindrical portion 168 the external surface of which incorporates a series of splines 178. It is this surface which provides purchase on, and causes rotation of, the roller blind tubing. This cylindrical portion 168 of the splined bush 112 also comprises a moulded indent 140 of width about $1/8^{th}$ the circumference of the cylindrical portion 168. As previously described, in use rotation of the sprocket wheel 104 causes the inner surface of this indent to be engaged by the edges 152 of cut-away portion of the sprocket wheel cylinder 142, which causes rotation of splined bush 112.

The most rearward portion of splined bush 112 is the center pin lug engagement surface 188 and it is this interaction with center pin lugs 136 that holds the control unit together during operation.

The upper housing body 30 further includes a pair of end plates (not shown) which close the ends of the housing body 30 and to which the control unit and idle end assembly are secured.

To assemble the roller blind of the invention, the upper housing 28 is assembled by rotatably mounting the roller tube 34 within the upper housing body 30. The bottom bar assembly is assembled by urging the two end caps 2 into the respective apertures defined at either end of the bottom bar 4. The deformable ribs 12 are deformed upon insertion of each end cap 2 into the bottom bar 4 to form a friction fit between the two components. The bottom bar assembly is then inserted into the hollow interior of the bottom bar housing body 20 and the two mounting elements 22*a*, 22*b* are inserted into the lower housing body 20 to close its ends and to support for rotation the bottom bar assembly. The apertures 14 of the respective end caps 2 receive the respective stub axles of the mounting elements 22*a*, 22*b* such that the end caps 2 are rotatably coupled to their respective closure elements 22*a*, 22*b* and the bottom bar 4 is mounted for rotation within the bottom bar housing body 19.

The sheet element 16 is secured at one end thereof within the sheet element securing channel 36 of the roller tube 34. The other end of the sheet element 16 passes into the bottom bar housing body 20 of the bottom bar housing 18 via the elongate upwardly facing slot and around the bottom bar 4. The sheet element 16 then exits the lower housing body 20 again via the elongate slot and returns to the upper housing, where it is secured to the sheet element securing portion 32 of the upper housing body 30. This forms the fixed element for the sheet element 16.

The blind is deployed (lowered) and retracted (raised) by operation of the roller tube 34 (via the control unit). This winds or unwinds one end of the sheet element 16, which in turn raises or lowers the return portion of the sheet element 16, as the opposite end of the sheet element 16 is fixed to the upper housing 28.

The rotation of the bottom bar 4 relative to the mounting elements 22*a*, 22*b* as the sheet element 16 is deployed or retracted minimises friction between the sheet element 16 and the bottom bar 4. In addition, the outwardly flared portion 10 of the end caps 2 maintains the sheet element 16 centred on the bottom bar 4 and prevents the edge of the sheet element 16 from rubbing upon an upstanding side portion of the end caps, thereby preventing or minimising the fraying of the side edge portions of the sheet element 16.

The invention claimed is:

1. A roller blind including a roller tube mounted for rotation; a fixed element located adjacent to the roller tube; and a sheet element which is secured at one end to the roller tube and at the opposite end to the fixed element such that the sheet element defines a return portion located between the two ends, wherein a roller blind bottom bar is located within the return portion, the roller blind bottom bar including a tubular body and an end cap at each end, the end caps including a proximal portion located adjacent to the tubular body, a distal portion spaced from the tubular body, and an outwardly flared portion located between the proximal and distal portions such that the end cap flares outwards from the proximal portion to the distal portion, said roller blind further including a bottom bar assembly comprising a housing body and a pair of opposed mounting elements forming respective end plates of the housing body, wherein said roller blind bottom bar is rotatably coupled to said mounting elements and disposed within the housing body, and wherein the housing body includes an axial slot through which the sheet element passes.

2. A roller blind according to claim 1, wherein the outwardly flared portion is frustoconical or trumpet-shaped.

3. A roller blind according to claim 1, wherein the bottom bar tubular body and the end caps are formed as a one-piece unit.

4. A roller blind according to claim 1, wherein the tubular body includes axial apertures at both ends and each end cap includes a projection which forms a friction fit within the respective aperture.

5. A roller blind according to claim 4, wherein the projection of each end cap includes one or more outwardly extending deformable ribs.

6. A roller blind according to claim 1, wherein the sheet element includes a plurality of panels and at least some of the panels have different light transmission properties.

7. A roller blind according to claim 1, wherein the fixed element comprises a housing within which the roller tube is rotatably mounted.

8. A roller blind according to claim 1, wherein the roller blind further includes a control unit for connection to the roller tube, wherein the control unit includes a drive bush connectable to the roller tube.

9. A roller blind according to claim 8, wherein the control unit further includes a clutch located between the sprocket wheel and the drive bush.

* * * * *